US009539633B2

(12) United States Patent
Traenklein et al.

(10) Patent No.: US 9,539,633 B2
(45) Date of Patent: Jan. 10, 2017

(54) MACHINE TOOL DRIVE SYSTEM

(71) Applicant: TRUMPF Werkzeugmaschinen GmbH + Co. KG, Ditzingen (DE)

(72) Inventors: Dennis Traenklein, Nufringen (DE); Joerg Neupert, Stuttgart (DE); Kai Etzel, Besigheim (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 14/952,085

(22) Filed: Nov. 25, 2015

(65) Prior Publication Data

US 2016/0144419 A1 May 26, 2016

(30) Foreign Application Priority Data

Nov. 26, 2014 (EP) ..... 14194914

(51) Int. Cl.

| | |
|---|---|
| ***B21D 28/20*** | (2006.01) |
| ***B21D 28/00*** | (2006.01) |
| ***B30B 1/40*** | (2006.01) |
| ***B21D 5/02*** | (2006.01) |
| ***B21J 5/02*** | (2006.01) |
| ***B21D 39/02*** | (2006.01) |
| ***B21D 11/08*** | (2006.01) |
| ***B21D 28/04*** | (2006.01) |

(52) U.S. Cl.

CPC ..... *B21D 28/002* (2013.01); *B21D 5/0272* (2013.01); *B21D 11/08* (2013.01); *B21D 28/04* (2013.01); *B21D 39/02* (2013.01); *B21J 5/022* (2013.01); *B30B 1/40* (2013.01)

(58) Field of Classification Search

CPC ..... B21D 5/0272; B21D 28/002; B21D 39/02; B21D 11/08; F16C 29/025; B30B 1/40; B21J 5/022

USPC ..... 72/452.9

See application file for complete search history.

(56) References Cited

U.S. PATENT DOCUMENTS

| | | | | |
|---|---|---|---|---|
| 2,199,864 A * | 5/1940 | Wehr | B21D 5/0272 | 72/448 |
| 3,743,469 A * | 7/1973 | Gibbons | B29C 45/68 | 100/271 |
| 3,982,416 A * | 9/1976 | Pozsgay | B21B 21/005 | 72/214 |
| 4,157,027 A * | 6/1979 | Graham | B21D 1/08 | 29/402.19 |

(Continued)

FOREIGN PATENT DOCUMENTS

| | | | |
|---|---|---|---|
| DE | 19954441 | * | 2/2001 |
| EP | 2527058 A1 | | 11/2012 |
| WO | 2007/1222294 | * | 11/2007 |

*Primary Examiner* — David B Jones

(74) *Attorney, Agent, or Firm* — Fish & Richardson P.C.

(57) ABSTRACT

A drive system for a machine tool comprises two, at least equally long drive spindles, extending parallel to each other and being structurally identical with regard to their torsional rigidity and their axial rigidity, which are each supported to rotate about a spindle axis, and which can be driven about the spindle axis concerned. Each of the drive spindles has a fixed bearing at one end, acting in its longitudinal direction. Spindle nuts, which are seated on the drive spindles can be moved simultaneously with longitudinal movements in the longitudinal direction of the drive spindles.

20 Claims, 4 Drawing Sheets

(56) References Cited

U.S. PATENT DOCUMENTS

| | | | | | |
|---|---|---|---|---|---|
| 4,535,689 | A * | 8/1985 | Putkowski | B30B 1/40 | 100/214 |
| 5,376,988 | A * | 12/1994 | Osanai | F16C 29/025 | 355/53 |
| 6,030,569 | A * | 2/2000 | Yu | B29C 45/661 | 264/272.17 |
| 6,644,089 | B1 * | 11/2003 | Gorgen | B21D 39/021 | 29/243.58 |
| 9,308,574 | B1 * | 4/2016 | Mele | B21J 5/022 | |
| 2010/0278606 | A1 | 11/2010 | Hyatt et al. | | |
| 2014/0090443 | A1 | 4/2014 | Schmauder et al. | | |

* cited by examiner

MACHINE TOOL DRIVE SYSTEM

CROSS REFERENCE TO RELATED APPLICATION

This application claims priority under 35 U.S.C. §119 to European Patent Application Serial Number 14 194 914.9, filed on Nov. 26, 2014. The contents of this priority application are hereby incorporated by reference in their entirety.

TECHNICAL FIELD

The invention relates to a drive system for a machine tool, in particular for a machine tool for sheet metal machining,

BACKGROUND

European patent application EP 2 527 058 A1 relates to a machine tool in the form of a press for processing workpieces, in particular metal sheets. A pressing tool is actuated by means of a wedge gear comprising two drive side gear wedges and two tool side gear wedges. The tool side gear wedges support the pressing tool. The drive side gear wedges are each provided with a spindle nut of a drive system in the form of a spindle drive. The spindle nuts are seated on a common drive spindle and each have a drive motor, by means of which they can be moved along the drive spindle jointly with the drive side wedge gears. Movements, which the drive side gear wedges perform simultaneously along the drive spindle and at relative to the tool side gear wedges, generate movements of the pressing tool in the transverse direction of the drive spindle due to the cooperation of the drive side gear wedges and the tool side gear wedges. If the drive side gear wedges are moved simultaneously and in the same direction along the drive spindle, the drive side gear wedges take the tool side gear wedges, and via these, the pressing tool, with them in the direction of movement. In this way, the pressing tool can be positioned along the drive spindle.

Trouble-free workpiece processing by means of the pressing tool and/or high processing precision require high positioning accuracy of the drive side gear wedges, and thus high positioning accuracy of the drive system used to move the drive side gear wedges.

SUMMARY

One aspect of the invention features a machine tool drive system that includes a spindle arrangement with at least one drive spindle and two spindle nuts movable by the spindle arrangement simultaneously with longitudinal movements in the longitudinal direction of the drive spindle.

In some embodiments of the invention, a spindle drive is provided as the drive system for a machining tool of a machine tool. The spindle drive comprises two drive spindles on each of which a spindle nut is seated that is able to be moved in the longitudinal direction of the drive spindle concerned. Both drive spindles are stationary in the longitudinal direction and rotatable about a spindle axis by means of a drive. A fixed bearing at one longitudinal end of each drive spindle ensures the support thereof in the longitudinal direction of the drive spindle. Due to the rotational drive of the drive spindles, which is stationary in the longitudinal direction, no drive motors moving jointly with the spindle nuts are needed to generate the longitudinal movements of the spindle nuts. Consequently, only relatively small masses must be moved during longitudinal movements of the spindle nuts. Therefore, there is no considerable impairment of the positioning accuracy of the spindle nuts caused by the inertia of masses of the spindle nuts in the longitudinal direction of the drive spindles.

For optimum synchronization of the longitudinal movements performed by the two spindle nuts, the two drive spindles should display the most uniform driving performance possible. According to particular embodiments of the invention, this is achieved by the drive spindles having the same length and being structurally identical with regard to their torsional rigidity and with regard to their axial rigidity. The torsional rigidity of the drive spindles is a deciding factor for the torsion of the drive spindles that occurs during operation. The axial rigidity of the drive spindles determines their length change under axial load. Axial forces can be exerted on the drive spindles, especially via the spindle nuts. Both the torsion and the length change of the drive spindles under axial load are proportional to the length of the drive spindles. In the interests of uniform driving performance, the drive spindles of the drive system can also be structurally identical with regard to their mass moments of inertia, i.e. with regard to the resistance they oppose to a change of their rotational state of movement. The mass moment of inertia of a drive spindle, perfectly cylindrical in a good approximation, is determined by its mass and its radius, wherein the radius of a perfectly cylindrical drive spindle influences both the torsional rigidity and the length change thereof under axial load (axial stiffness).

Uniform driving performance of the drive spindles for the spindle nuts is also obtained due to the fact that, at the beginning of the simultaneous longitudinal movements of the spindle nuts, the distances between the spindle nuts seated on the drive spindles and the fixed bearing of the associated drive spindle match each other.

Preferably, the equidistance of the spindle nuts and the fixed bearings of the drive spindles is preserved during the longitudinal movements of the spindle nuts in the longitudinal direction of the drive spindles. To this end, with longitudinal movements of the spindle nuts performed in the same direction, the fixed bearings of the drive spindles are placed on one and the same side of the spindle nuts. If the spindle nuts perform opposing longitudinal movements along the drive spindles, the original equidistance of the spindle nuts and fixed bearings is preserved, provided that the fixed bearings of the drive spindles are situated on opposite sides of the spindle nuts. In either case, each spindle drive of the drive system should be configured such that, during their longitudinal movements, the spindle nuts travel at identical speeds along the drive spindles.

The preservation of the equidistance of the spindle nuts and of the fixed bearings of the drive spindles driving the spindle nuts, present at the start of the simultaneous longitudinal movements of the spindle nuts, during the simultaneous longitudinal movements of the spindle nuts is, however, not an indispensable characteristic of the invention. The preservation of the equidistance of the spindle nuts and the fixed bearings of the drive spindles is rather negligible in cases where the spindle nuts, during their simultaneous longitudinal movements, are displaced relative to each other only over relatively short path lengths.

According to particular embodiments, the invention is provided on or as a machine tool. In order to generate movements of the machining tool of the machine tool in such embodiments, two drive side wedge gear elements and two tool side wedge gear elements cooperate with each other. Each of the drive side wedge gear elements is connected with one of the spindle nuts of the drive system, each of the tool side wedge gear elements is connected with the machining tool.

A drive system whose spindle nuts can be moved simultaneously and with opposing longitudinal movements by means of the drive spindles, serves, in the case of particular embodiments of the machine tool, to drive the drive side wedge gear elements, connected with the spindle nuts, in opposite directions and thereby to drive the machining tool via the tool side wedge gear elements in the transverse direction of the drive spindles. During a transverse movement generated in this way, the machining tool can perform in particular a working stroke.

The simultaneous and longitudinal movements in the same direction of the spindle nuts, generated by means of the drive system according to certain embodiments of the invention are used to move the drive side wedge gear elements, connected with the spindle nuts, jointly with the tool side wedge gear elements and the machining tool of the machine tool connected with the tool side wedge gear elements, in the longitudinal direction of the drive spindles. Such longitudinal movements of the machining tool can be performed, in particular for positioning the machining tool relative to a workpiece to be machined and/or relative to a complementary machining tool.

In particular embodiments, the spindle nuts lie close together at a short distance in the transverse direction of the drive spindles, and can even overlap each other in the transverse direction of the drive spindles. This allows a space-saving construction of the drive system in the transverse direction of the drive spindles.

In certain embodiments, the drive side wedge gear elements, connected with the spindle nuts, are spaced apart at the beginning of their simultaneous longitudinal movements in the longitudinal direction of the drive spindles. Consequently, the drive side wedge gear elements can be moved from their starting positions to converge with simultaneous opposing longitudinal movements, without the drive side wedge gear elements having to pass each other in this instance. This in turn allows an arrangement of the drive side wedge gear elements close to each other in the transverse direction of the drive spindles, and even to place the drive side wedge gear elements, overlapping one another, in the transverse direction of the drive spindles. In any case, the space requirement of the wedge gear in the transverse direction of the drive spindles is relatively small. With the drive side wedge gear elements overlapping one another in the transverse direction of the drive spindles, the possibility furthermore exists of guiding the two drive side wedge gear elements on a common longitudinal guide during their simultaneous movements in the longitudinal direction of the drive spindles.

In addition to simultaneous opposing longitudinal movements, the spindle nuts and the drive side wedge gear elements of various embodiments of the invention, connected with the spindle nuts, also perform simultaneous and equally directed longitudinal movements in the longitudinal direction of the drive spindles. Consequently, the drive side wedge gear elements can generate not only movements of the machining tool in the transverse direction of the drive spindles, but can also position the entire unit, consisting of the drive side wedge gear elements, tool side wedge gear elements and machining tool, along the drive spindles. At the beginning of the longitudinal movements, the spindle nut and the drive side wedge gear element on one of the drive spindles are in this instance distanced from the spindle nut and the drive side wedge gear element on the other drive spindle in the longitudinal direction of the drive spindles. As a result, during the simultaneous and equally directed longitudinal movements, one of the spindle nuts and the drive side wedge gear element connected therewith move ahead of the other spindle nut and the drive side wedge gear element connected therewith in the direction of the simultaneous and equally directed longitudinal movements. So that, notwithstanding this, during movements towards the fixed bearings, the spindle nut moving behind in the direction of the simultaneous and equally directed longitudinal movements and the wedge gear element connected therewith can move up to the fixed bearing of the associated drive spindle, and thereby make maximum use of the travelling path provided by the associated drive spindle, the fixed bearing of the drive spindle of the spindle nut moving behind is provided, in particular located, such that it can be passed by the spindle nut moving ahead and/or by the moving ahead drive side wedge gear element in the direction of the simultaneous and equally directed longitudinal movements of the drive side wedge gear elements and of the spindle nuts. As a supplement or alternative, in certain embodiments the spindle nut and/or the drive side wedge gear element, which are moved along one of the drive spindles, passes or pass another bearing, for example a floating bearing, of the other drive spindle.

In order to enable the spindle nut moving ahead to pass the fixed bearing of the drive spindle of the spindle nut moving behind, the drive spindle of the spindle nut moving ahead must extend further in the direction of the simultaneous and equally directed longitudinal movements of the drive side wedge gear elements and spindle nuts than the drive spindle of the spindle nut moving behind, this drive spindle ending at the fixed bearing to be passed. Since both drive spindles have the same length, to that end, they are offset in their longitudinal direction in certain embodiments.

For applications in which the drive spindles of the drive system are not directly connected with the motor shafts of the associated drive motors, an example of the invention provides a drivetrain between each of the drive spindles and the associated drive motor, the drivetrain having at least one driving element, via which the drive spindle concerned can be driven by the associated drive motor. In order to enable the drive spindles to display a uniform driving performance for the spindle nuts, irrespective of the drivetrains, the two drivetrains are structurally identical, at least with regard to their torsional rigidity. Uniform axial rigidity of the drivetrains can be dispensed with, provided that the drivetrains are supported in the axial direction towards the drive spindles, for example at the fixed bearings of the drive spindles such that length changes on the drivetrains do not affect the driving performance of the drive spindles. Against this background, in particular embodiments of the drive system, the drivetrains are each placed between the fixed bearing of the drive spindles and the associated drive motor.

In a further embodiment of the invention, a spindle extension can be provided as a driving element of at least one of the drivetrains, the spindle extension extending in the longitudinal direction of the drive spindle concerned and being non-rotationally connected therewith. Spindle extensions of the described type can be flexibly dimensioned and as a result, allow, in particular, a flexible arrangement relative to each other of the drive spindles and of the drive motors provided to drive them in rotation.

As a supplement or alternative, couplings can be provided as drive elements of the drivetrains, these couplings being provided between the drive motors of the drive spindles on the one hand and the drive spindles on the other hand. In the interests of uniform driving performance of the drive spindles, the couplings are also designed to be structurally identical, at least with regard to their torsional rigidity.

If both drive spindles are connected by means of a spindle extension to the associated drive motor, it is advisable for the two spindle extensions to be designed to be structurally identical, at least with regard to their torsional rigidity. Identical torsional rigidity of the two spindle extensions contributes to uniform driving performance of the drive spindles connected with the spindle extensions.

Uniform torsional rigidity of the spindle extensions is realized in a further configuration of the invention in a simple way, in that the spindle extensions are either equally long with the same size of cross section, or have different lengths with different cross section sizes.

In some embodiments having a spindle extension between at least one of the drive spindles and the associated drive motor, the fixed bearing of the drive spindle set back in the direction of the simultaneous and equally directed longitudinal movements of the drive side wedge gear elements and the spindle nuts can be passed by the spindle nut moving ahead in said direction and/or by the drive side wedge gear element moving ahead in said direction. According to various embodiments of the invention, by means of the spindle extension provided for the drive spindle set back, care is taken to ensure that sufficient free space is available, between the end of the drive spindle set back, provided with the fixed bearing concerned, and the drive motor associated therewith, for accommodating the spindle nut that has moved past the fixed bearing of the drive spindle set back and/or to accommodate the drive side wedge gear element connected with that spindle nut. In this instance, it is conceivable that the drive spindle, set forward in the direction of the simultaneous and equally directed longitudinal movements of the drive side wedge gear elements and the spindle nuts, is also provided with a spindle extension. That spindle extension can, if appropriate, be shorter than the spindle extension of the drive spindle set back in said direction. If this is the case, for unification of the torsional rigidity of the spindle extensions having different lengths, the cross section of the longer spindle extension is dimensioned larger than the cross section of the shorter spindle extension.

Various implementations of the invention can provide a drive system with particularly high positioning accuracy.

The invention will be described in more detail below by means of schematic representations given by way of example.

DETAILED DESCRIPTION

Figure 1:
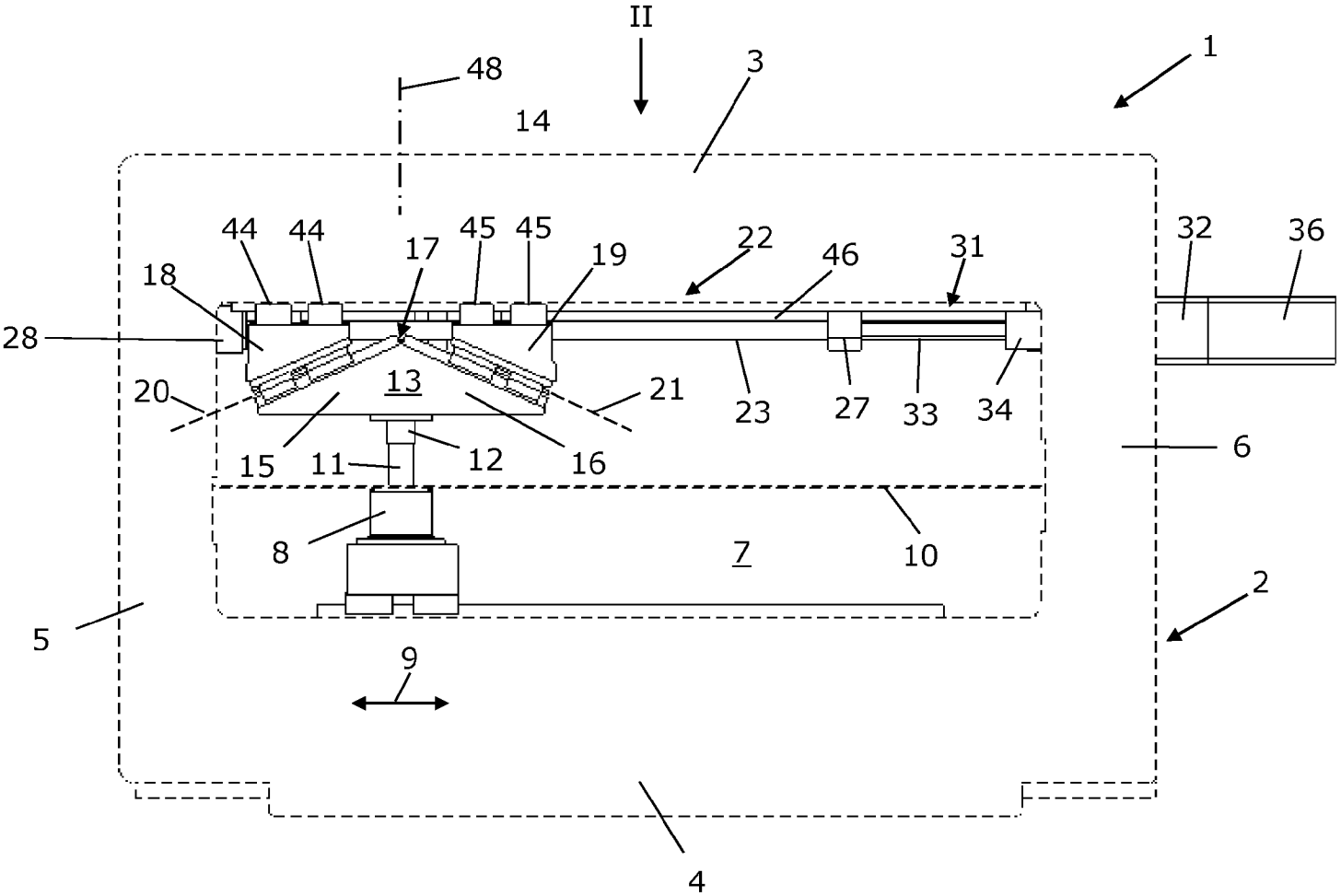
FIG. 1 shows a machine tool having a drive system of a first design for a machining tool.

According to FIG. 1, a machine tool realized as a punch press 1 has an O-shaped machine frame with horizontal frame legs 3, 4 and vertical frame legs 5, 6. The machine frame 2 surrounds a frame interior space 7.

Inside the frame interior space 7, a punching die 8 is guided on the lower horizontal frame leg 4 to move in the direction of a double arrow 9. On its upper side, the punching die 8 forms a support for a metal sheet 10 shown in FIGS. 1 and 3 by a dotted line. A die opening, circular in the illustrated example, of the punching die 8 can be seen in FIG. 2. The metal sheet 10 can be moved, respectively positioned, perpendicular to the drawing plane of FIG. 1 by means of a workpiece guide not illustrated in the figures.

For punch machining of the metal sheet 10, a punch 11 provided as a machining tool cooperates with the punching die 8. The punch 11 is fixed, at the end remote from the punching die 8, in a punch receptacle 12, which in turn is supported at a double wedge 13 and adjustable by rotation in the direction of a double arrow 14.

The double wedge 13 consists of two tool side gear wedges 15, 16, which are the tool side wedge gear elements of a wedge gear 17. The wedge gear 17 includes two drive side gear wedges 18, 19 as drive side wedge gear elements.

The drive side gear wedge 18 and the tool side gear wedge 15 are associated with each other and form a first wedge gear element pair, respectively gear wedge pair. A second wedge gear element pair, respectively gear wedge pair, comprises the drive side gear wedge 19 and the tool side gear wedge 16. The double wedge 13 with the tool side gear wedges 15, 16 is suspended on the drive side gear wedges 18, 19. The drive side gear wedge 18 can be moved along a line 20 relative to the tool side gear wedge 15, and the drive side gear wedge 19 can be moved along a line 21 relative to the tool side gear wedge 16.

Appropriate movements of the drive side gear wedges 18, 19 are generated by means of a drive system realized as a spindle drive 22. Details of the spindle drive 22 can be seen in particular in FIG. 2.

Figure 2:
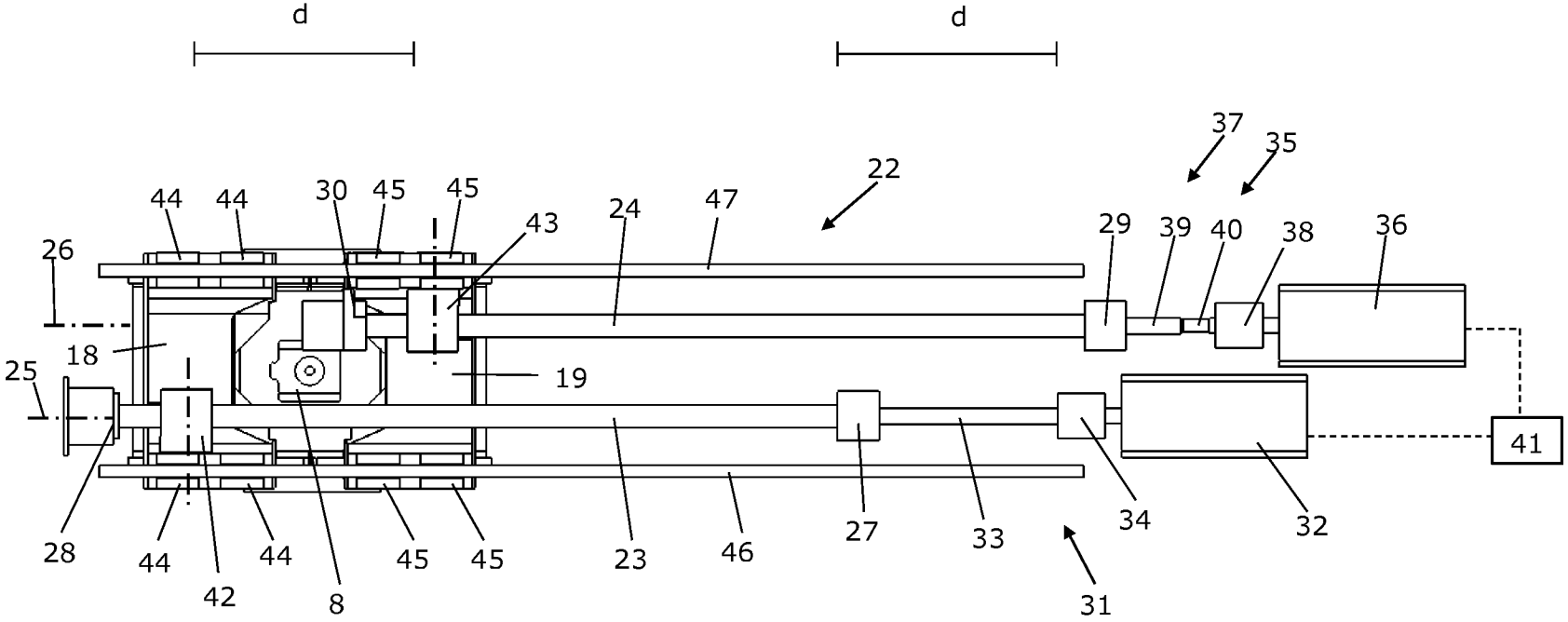
FIG. 2 shows a drive system of the machine tool according to FIG. 1, viewed in the direction of arrow II in FIG. 1.
Figure 3:
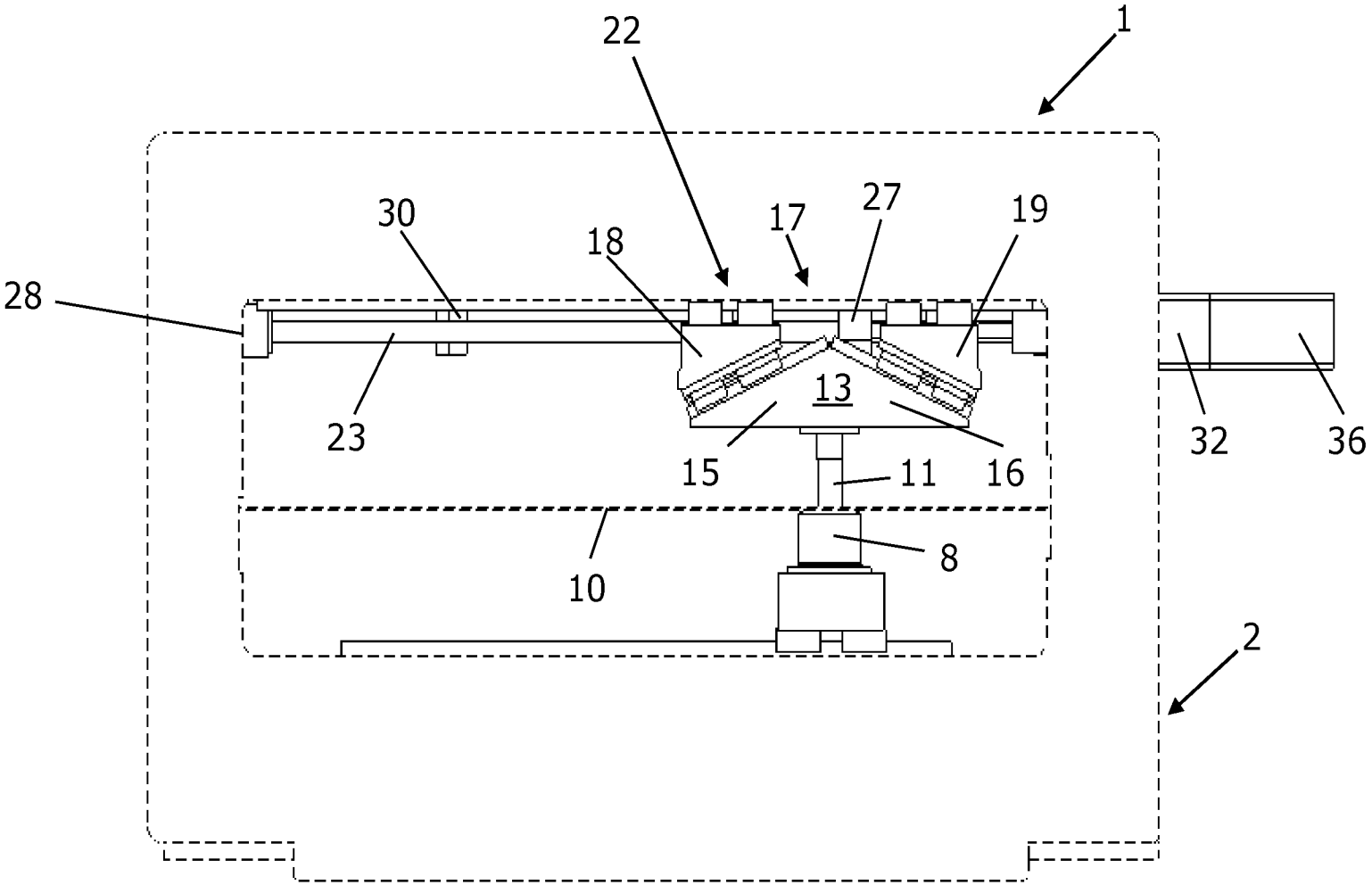
FIG. 3 shows the machine tool according to FIG. 1 with the machining tool in a changed position compared with FIG. 1.

According to FIG. 2, the spindle drive 22 includes a first drive spindle 23 and a second drive spindle 24. The first drive spindle 23 and the second drive spindle 24 extend parallel to each other along the upper horizontal frame leg 3 of the machine frame 2. In the views of FIGS. 1 and 3, the second drive spindle 24 is hidden by the first drive spindle 23. A first spindle axis 25 of the first drive spindle 23 and a second spindle axis 26 of the second drive spindle 24 (FIG. 2) lie in one and the same horizontal plane.

The first drive spindle 23 is supported on the machine frame 2 to rotate about the first spindle axis 25 by means of a first fixed bearing 27 and a first floating bearing 28. Correspondingly, a second fixed bearing 29 and a second floating bearing 30 support the second drive spindle 24 on the machine frame 2 to rotate about the second spindle axis 26. In the axial direction, the first drive spindle 23 is supported on the machine frame 2 by the first fixed bearing 27 and the second drive spindle 24 is supported on the machine frame 2 by the second fixed bearing 29.

The first drive spindle 23 and the second drive spindle 24 are structurally identical and are, in particular, of the same length. They have an identical torsional rigidity and an identical axial rigidity, as well as an identical mass moment of inertia.

The first drive spindle 23 is connected in drive with a first drive motor 32 via a first drivetrain 31. The first drivetrain 31 comprises a first spindle extension 33 and a first coupling 34. The first spindle extension 33 extends from the end of the first drive spindle 23 at the first fixed bearing 27, up to the first coupling 34. At the first fixed bearing 27, the first spindle extension 33 is non-rotationally connected with the first drive spindle 23 and, furthermore supported on the machine frame 2 in the longitudinal direction of the first drive spindle 23. The first coupling 34 connects makes the first spindle extension 33 and the motor shaft of the first drive motor 32 with one another.

A second drivetrain 35 between the second fixed bearing 29 and a second drive motor 36 comprises a second spindle extension 37, non-rotationally connected with the local end of the second drive spindle 24 at the second fixed bearing 29 and supported on the machine frame 2 in the longitudinal direction of the second drive spindle 24, and further comprises a second coupling 38, at which a drive connection is made between the second spindle extension 37 and the motor shaft of the second drive motor 36.

The first drivetrain 31 and the second drivetrain 35 have an identical torsional rigidity, wherein the torsional rigidity of the first drivetrain 31 combines the torsional rigidity of the first spindle extension 33 and that of the first coupling 34 and wherein the torsional rigidity of the second drivetrain 35 combines the torsional rigidity of the second spindle extension 37 and that of the second coupling 38.

The first coupling 34 and the second coupling 38 are structurally identical with regard to their torsional rigidity. The same must apply to the first spindle extension 33 and the second spindle extension 37, so that the torsional rigidity of the entire first drivetrain 31 matches that of the entire second drivetrain 35.

Due to the lengths given, the longer first spindle extension 33 had a lower torsional rigidity than the shorter second spindle extension 37, if the cross sections of the first spindle extension 33 and the second spindle extension 37 were identical. In order to compensate for the effect of the length difference between the first spindle extension 33 and the second spindle extension 37 on the torsional rigidity of the first spindle extension 33 and that of the second spindle extension 37, the second spindle extension 37 has a stepped cross section. Only a first partial length 39 of the second spindle extension 37 has the same cross section as the first spindle extension 33. A second partial length 40 of the second spindle extension 37 is reduced in cross section compared with the first partial length 39 of the second spindle extension 37 and therefore also compared with the first spindle extension 33.

The first drive motor 32 and the second drive motor 36 can be controlled independently of each other. The direction of rotation of the two drive motors 32, 36 can be switched over. A numerical machine control 41, shown in FIG. 3, is used to control the first drive motor 32 and the second drive motor 36, and controls all essential functions of the punch press 1.

A first spindle nut 42 can be moved in the longitudinal direction of the drive spindles 23, 24 by means of the first drive spindle 23 driven by the first drive motor 32. Correspondingly, a second spindle nut 43, seated on the second drive spindle 24, can be moved in the longitudinal direction of the drive spindles 23, 24 by means of the second drive spindle 24 driven by the second drive motor 36. The spindle drives formed on the one hand by the first drive spindle 23 and the first spindle nut 42 and on the other hand by the second drive spindle 24 and the second spindle nut 43 are structurally identical. As a particular result, the first spindle nut 42 and the second spindle nut 43 move over identical path lengths along the first drive spindle 23 and the second drive spindle 24 if the revolutions of the drive motors 32, 36 are identical.

The first spindle nut 42 is connected with the drive side gear wedge 18, the second spindle nut 43 with the drive side gear wedge 19. Consequently, the drive side gear wedges 18, 19 follow the longitudinal movements of the spindle nuts 42, 43 in the longitudinal direction of the drive spindles 23, 24. During their longitudinal movements, the drive side gear wedge 18 is guided by guide shoes 44 and the drive side gear wedge 19 is guided by guide shoes 45, on guide rails 46, 47 of the machine frame 2, which accordingly form a common guide for the drive side gear wedges 18, 19 in the longitudinal direction of the drive spindles 23, 24.

In FIGS. 1 and 2, the punch press is shown in an operational state in which the punch 11 and the punching die 8 are situated in one of their end positions along the horizontal frame legs 3, 4 of the machine frame 2. The free end of the punch 11 is slightly above a metal sheet 10 resting on the punching die 8. The first spindle nut 42 and the second spindle nut 43 have traveled on the first drive spindle 23 and the second drive spindle 24 into positions at which the distance between the first spindle nut 42 (center of the first spindle nut 42, shown with dots and dashes in FIG. 2) and the first fixed bearing 27 of the first drive spindle 23 matches the distance between the second spindle nut 43 (center of the second spindle nut 43, shown with dots and dashes in FIG. 2) and the second fixed bearing 29 of the second drive spindle 24. In the longitudinal direction of the drive spindles 23, 24, the first spindle nut 42 and the second spindle nut 43 are spaced from each other by a distance value d. The first drive spindle 23 and the second drive spindle 24, as well as the first fixed bearing 27 and the second fixed bearing 29 are also offset relative to each other by the distance value d, in the longitudinal direction of the equally long drive spindles 23, 24.

If, starting from the situation illustrated in FIGS. 1 and 2, punch machining is to be performed on the metal sheet 10, supported on the punching die 8, by means of the punch 11 and the punching die 8, the punch 11 must be lowered with a working stroke along a stroke axis 48. To that end, the first drive spindle 23 and the second drive spindle 24 are driven by means of the first drive motor 32 and the second drive motor 36 with rotational movements about the first spindle axis 25 and the second spindle axis 26. The direction of rotation and the speed of rotation of the first drive motor 32 and the first drive spindle 23 as well as the direction of rotation and the speed of rotation of the second drive motor 36 and the second drive spindle 24 are in this instance chosen such that the first spindle nut 42 and the second spindle nut 43 move in the longitudinal direction of the drive spindles 23, 24, simultaneously and at the same speed, and in opposing directions towards each other. Corresponding longitudinal movements of the drive side gear wedge 18, connected with the first spindle nut 42, and of the drive side gear wedge 19, connected with the second spindle nut 43, are combined with the longitudinal movements performed by the first spindle nut 42 and the second spindle nut 43 along the drive spindles 23, 24. As a result, the drive side gear wedge 18 moves along the line 20 relative to the tool side gear wedge 15 and the drive side gear wedge 19 moves along the line 21 relative to the tool side gear wedge 16. The punch 11 is thereby lowered by the wedge gear 17 from the position according to FIG. 1, along the stroke axis 48. The punch 11 thereby penetrates the metal sheet 10 and enters the die opening of the punching die 8.

Due to the particular configuration of the spindle drive 22, the described lowering movement of the punch 11 is performed as a straight linear movement along the stroke axis 48, and therefore without a movement component in the longitudinal direction of the drive spindles 23, 24. These kinematics of the punch 11 result from the fact that the drive spindles 23, 24 display a uniform drive performance for the spindle nuts 42, 43, and via these, also for the drive side gear wedges 18, 19.

The reason for this is on the one hand the fact that, at the start of the simultaneous longitudinal movements of the spindle nuts 42, 43, the distance between the first spindle nut 42 and the first fixed bearing 27 of the associated first drive spindle 23, and the distance between the second spindle nut 43 and the second fixed bearing 29 of the associated second drive spindle 24 are identical. Furthermore, the first drive spindle 23 and the second drive spindle 24 match each other with regard to their torsional rigidity and their axial rigidity, and also with regard to their mass moment of inertia. Finally, the first drivetrain 31 of the first drive spindle 23 and the second drivetrain 35 of the second drive spindle 24 also have an identical torsional rigidity.

In the interaction, all of these characteristics of the spindle drive 22 have the effect that the first spindle nut 42 and the second spindle nut 43 converge during their longitudinal movements along identical path lengths in the longitudinal direction of the drive spindles 23, 24.

Due to the likewise matching construction of the gear wedge pairs of the wedge gear 17, formed, on the one hand, by the drive side gear wedge 18 and the tool side gear wedge 15, and on the other hand, by the drive side gear wedge 19 and the tool side gear wedge 16, the longitudinal movements, identical according to their amount, of the first spindle nut 42 and the second spindle nut 43 along the drive spindles 23, 24 are converted to lowering movements, of the same amount, of the tool side gear wedges 15, 16. This in turn results in a lowering movement, free of tilting movements and lateral shifting movements, of the punch 11, that is connected via the wedge gear 17 to the spindle drive 22.

The fact that in the course of the converging longitudinal movements of the first spindle nut 42 and the second spindle nut 43, the distance between the first spindle nut 42 and the first fixed bearing 27 of the first drive spindle 23 and the distance between the second spindle nut 43 and the second fixed bearing 29 of the second drive spindle 24 differ more and more from each other, has no significant effect on the exact linearity of the lowering movement of the punch 11, since the path lengths along which the spindle nuts 42, 43 move during their opposing longitudinal movements are only relatively short and therefore, even at the end of the opposing longitudinal movements of the first spindle nut 42 and the second spindle nut 43, the distance between the first spindle nut 42 and the first fixed bearing 27 of the first drive spindle 23 only differs slightly from the distance between the second spindle nut 43 and the second fixed bearing 29 of the second drive spindle 24.

After the punching stroke, the punch 11 is withdrawn along the stroke axis 48 from its lowered position to the position according to FIG. 1. To that end, the first spindle nut 42 and the second spindle nut 43 are moved back to the positions according to FIGS. 1 and 2, by means of the first drive motor 32 and the first drive spindle 23 and by means of the second drive motor 36 and the second drive spindle 24 with opposing longitudinal movements, directed away from each other, in the longitudinal direction of the drive spindles 23, 24. The return stroke of the punch 11 is also performed as an exact linear movement along the stroke axis 48 due to the particular configuration of the spindle drive 22. At the end of the return stroke movement of the punch 11, the punch press 1 has returned to the operating state according to FIGS. 1 and 2.

If punching out of the metal sheet 10 is to be performed on the opposite side of the machine frame 2, the punching die 8 and the wedge gear 17 with the punch 11 must first be positioned accordingly. To that end, the punching die 8 is moved, by means of a drive, not illustrated and likewise controlled by the numerical machine control 41, from the position according to FIGS. 1 and 2 to the position according to FIG. 3. The target position of the punching die 8 is stored in the numerical machine control 41.

At the same time as the punching die 8, the wedge gear 17 and the punch 11 are moved, numerically controlled, to a target position corresponding to the target position of the punching die 8 by means of the spindle drive 22. In order to perform this positioning movement, the first drive motor 32 and the first drive spindle 23, as well as the second drive motor 36 and the second drive spindle 24 are operated such that the first spindle nut 42 and the second spindle nut 43 move simultaneously and at the same speed, and with equally directed longitudinal movements from their start positions according to FIGS. 1 and 2 to their target positions in the longitudinal direction of the drive spindles 23, 24.

Due to the particular configuration of the spindle drive 22, the equally directed longitudinal movements of the first spindle nut 42 and the second spindle nut 43 are exactly synchronized. The exact synchronization of the equally directed longitudinal movements of the first spindle nut 42 and the second spindle nut 43 is of particular advantage.

It allows on the one hand an exact approach to the target positions by the spindle nuts 42, 43, and therefore also by the wedge gear 17 and the punch 11. The exact synchronization of the equally directed longitudinal movements of the first spindle nut 42 and the second spindle nut 43 further has the effect that, irrespective of the relatively long travelling path, the first spindle nut 42 and the second spindle nut 43 are spaced at their target positions with the same distance value from each other as at the beginning of their equally directed longitudinal movements. The first spindle nut 42 and the second spindle nut 43 preserve their initial distance d until the end of their equally directed longitudinal movements. As a result, during the equally directed longitudinal movements, no relative movements occur of the drive side gear wedges 18, 19 connected with the spindle nuts 42, 43 relative to the tool side gear wedges 15, 16. This in turn results in the double wedge 13 preserving the position shown in FIG. 1, along the stroke axis 48 during its positioning movement. Consequently, during the equally directed longitudinal movements of the spindle nuts 42, 43, the punch 11 therefore changes its position exclusively in a horizontal direction along the drive spindles 23, 24. Finally, due to the exact synchronization of the equally directed longitudinal movements of the first spindle nut 42 and the second spindle nut 43, the distance between the first spindle nut 42 and the fixed bearing 27 of the first drive spindle 23 and the distance between the second spindle nut 43 and the fixed bearing 29 of the second drive spindle 24 is identical also at the target positions of the spindle nuts 42, 43, which in turn contributes to the fact that the drive spindles 23, 24 display a uniform drive performance during stroke movements of the punch 11 along the stroke axis 48, which stroke movements are performed after the positioning of the wedge gear 17 and the punch 11.

At the end of the equally directed longitudinal movements of the spindle nuts 42, 43 and the associated positioning movement of the wedge gear 17 and the punch 11, the situation illustrated in FIG. 3 occurs.

The first spindle nut 42 and the drive side gear wedge 18 still are arranged on the left side of the first fixed bearing 27 of first drive spindle 23. The floating bearing 30 of the second drive spindle 24 was passed by the first spindle nut 42 and the drive side gear wedge 18. Due to an appropriate arrangement and structural configuration of the first spindle nut 42, of the drive side gear wedge 18 and of the floating bearing 30, the first spindle nut 42 and the drive side gear wedge 18 can move past the floating bearing 30 without collision.

The second spindle nut 43 and the drive side gear wedge 19 have, in the course of the positioning movement of the gear wedge 17, passed the first fixed bearing 27 of first drive spindle 23 in the direction of movement. This was possible due to an appropriate arrangement and structural configuration of the second spindle nut 43 and the drive side gear wedge 19, and also due to an appropriate arrangement and configuration of the first fixed bearing 27 of first drive spindle 23.

In order to enable the second spindle nut 43 and the drive side gear wedge 19 to reach the positions according to FIG. 3 in the longitudinal direction of the drive spindles 23, 24, an appropriate free space should be made available to the right of the first fixed bearing 27 of the first drive spindle 23. This free space is obtained by an appropriate dimensioning of the first spindle extension 33 of the first drivetrain 31 provided between the first fixed bearing 27 and the first drive motor 32. The second drivetrain 35 can be shorter than the first drivetrain 31 in the given circumstances.

For this reason, the second spindle extension 37 of the second drivetrain 35 is shortened in relation to the first spindle extension 33 of first drivetrain 31. So that, irrespective of the different lengths of the first spindle extension 33 and the second spindle extension 37, the torsional rigidity of the first spindle extension 33 is identical to that of the second spindle extension 37, the diameter reduction described above is provided on the second spindle extension 37.

Once the punching die 8 and the wedge gear 17 with the punch 11 have reached the position according to FIG. 3, punch machining of the metal sheet 10 can be performed in the way previously described by simultaneous opposing longitudinal movements of the first spindle nut 42 and the second spindle nut 43 in the longitudinal direction of the drive spindles 23, 24. Because the wedge gear 17 and the punch 11 are exactly positioned in the longitudinal direction of the drive spindles 23, 24, the punch 11 is arranged exactly concentric with the die opening of the punching die 8, and therefore can enter reliably and trouble-free into the die opening of the punching die 8 in order to machine the metal sheet 10.

Figure 4:
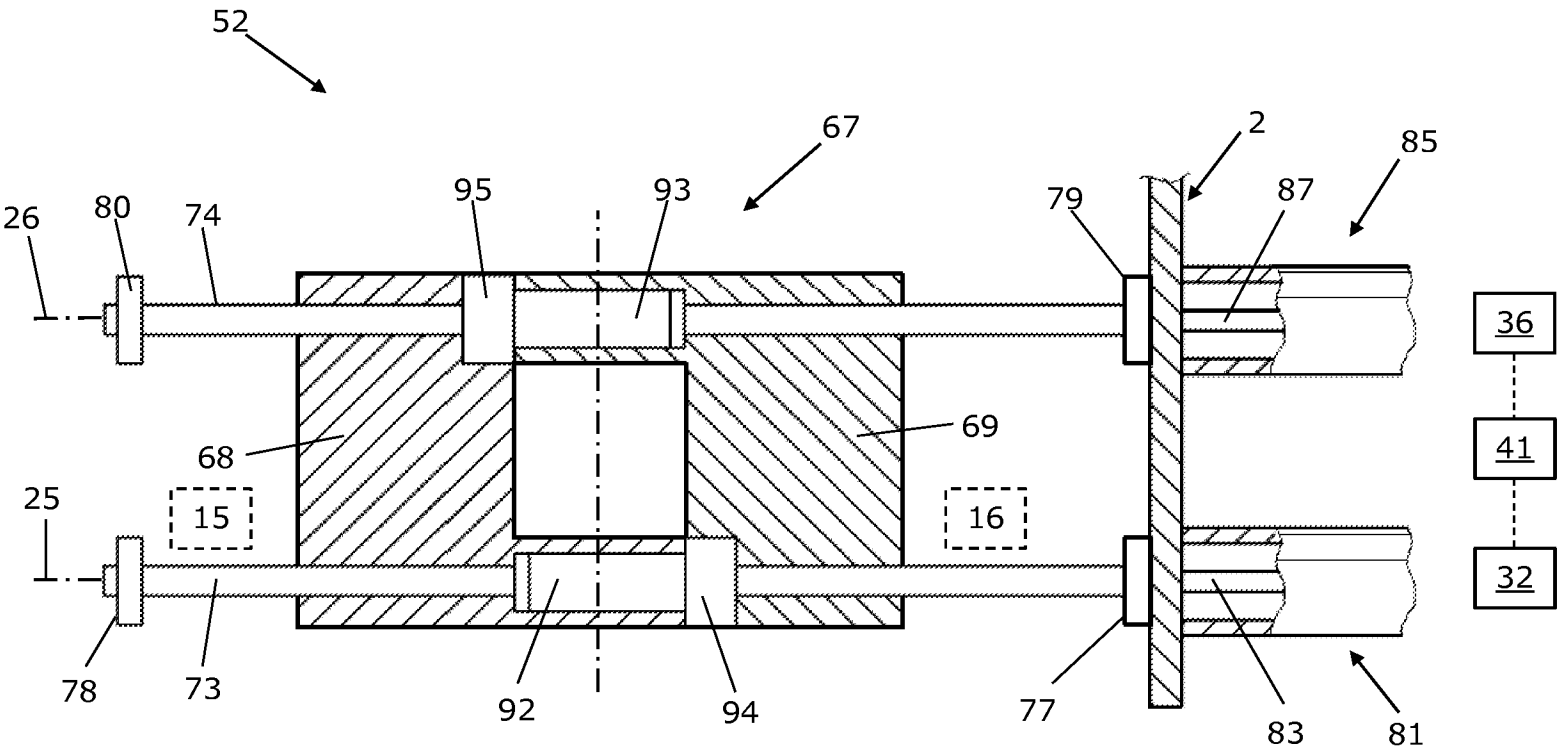
FIG. 4 shows a drive system of a second design for the machining tool of the machine tool according to FIGS. 1 and 3.

FIG. 4 shows a drive system in the form of a spindle drive 52, which can be used on the punch press 1 in place of the spindle drive 22, described in detail above. The spindle drive 52 is largely identical with the spindle drive 22 with regard to structure and functionality.

A first spindle nut 92 is connected with a drive side gear wedge 68, a second spindle nut 93 is connected with a drive side gear wedge 69. A first drive spindle 73 supporting the first spindle nut 92 and a second drive spindle 74 supporting the second spindle nut 93 extend parallel to each other and have the same length, and are structurally identical with regard to their torsional rigidity, their axial rigidity and their mass moment of inertia. The first drive spindle 73 can be driven about a first spindle axis 25 by means of a first drive motor 32. A second drive motor 36 serves to drive the second drive spindle 74 about at the second spindle axis 26.

A first fixed bearing 77 and a first floating bearing 78 are provided to rotatably support the first drive spindle 73. The rotational support of the second drive spindle 74 is achieved by means of a second fixed bearing 79 and a second floating bearing 80. Additionally, the first drive spindle 73 is supported in the axial direction on the machine frame 2 by means of the first fixed bearing 77 and the second drive spindle 74 is supported in the axial direction on the machine frame 2 by means of the second fixed bearing 79. The first drive spindle 73 is linked with the drive motor 32 by means of a first drivetrain 81 including a first spindle extension 83. Correspondingly, a second drivetrain 85 including a second spindle extension 87 is provided between the second drive spindle 74 and the drive motor 36.

In accordance with the situation at the spindle drive 22, tool side gear wedges 15, 16 are suspended on the drive side gear wedges 68, 69, and form a wedge gear 67 together with the drive side gear wedges 68, 69 for generating stroke movements of the punch 11.

Unlike the spindle drive 22, the first spindle nut 92 and the second spindle nut 93 are not distanced from each other on the spindle drive 52 at the beginning of their simultaneous longitudinal movements in the longitudinal direction of the drive spindles 73, 74. During opposing longitudinal movements, such as those performed to generate a working stroke of the punch 11, the first spindle nut 92, with a projection, supporting it in rotation, of the drive side gear wedge 68, enters a recess 94 at the drive side gear wedge 69 and the second spindle nut 93 moves, with a projection of the drive side gear wedge 69 supporting the second spindle nut 93, into a recess 95 of the drive side gear wedge 68.

The measures previously described in detail are also taken at the spindle drive 52 in order to provide uniform drive performance of the drive spindles 73, 74 and therefore exact movement and/or positioning of the punch 11.

A number of embodiments of the invention have been described. Nevertheless, it will be understood that various modifications may be made without departing from the spirit and scope of the invention. Accordingly, other embodiments are within the scope of the following claims.

What is claimed is:

1. A machine tool drive system comprising:

a spindle arrangement that has at least one drive spindle; and two spindle nuts, the spindle arrangement comprising two drive spindles extending parallel to each other along a longitudinal direction, each drive spindle supported for rotation about a respective spindle axis and configured to be driven about the respective spindle axis, the two drive spindles being of identical torsional and axial rigidity and each having a fixed bearing at one end, acting in the longitudinal direction of the respective drive spindle;

wherein the two spindle nuts are configured to be moved by the spindle arrangement simultaneously with longitudinal movements in the longitudinal direction of the drive spindles, each of the spindle nuts seated on an associated one of the two drive spindles;

wherein the spindle nuts are moveable by the spindle arrangement, in the longitudinal direction of the drive spindles, by each of the spindle nuts being movable by the associated drive spindle;

wherein at the start of their simultaneous longitudinal movements, the spindle nuts are distanced from each other by a distance value (d), different from zero, in the longitudinal direction of the drive spindles, and wherein the drive spindles are offset relative to each other, in the longitudinal direction, by the distance value (d).

2. The drive system according to claim 1, wherein the drive spindles are of the same length.

3. The drive system according to claim 1, wherein, at the start of the simultaneous longitudinal movements of spindle nuts, a first distance existing in the longitudinal direction of the drive spindles between one spindle nut and the fixed bearing of its associated drive spindle is identical with a second distance existing between the other spindle nut and the fixed bearing of its associated drive spindle.

4. The drive system according to claim 1, wherein the spindle nuts are configured to be moved by the two drive spindles simultaneously and with opposing longitudinal movements.

5. The drive system according claim 1, wherein the spindle nuts are configured to be moved by the two drive spindles simultaneously and with longitudinal movements in the same direction.

6. The drive system according to claim 1, further comprising two drive motors, each drive motor engaging a respective one of the two drive spindles, and two drivetrains, each drivetrain connecting a respective one of the drive spindle to a respective one of the drive motors, and wherein the drivetrains are of equivalent torsional rigidity.

7. The drive system according to claim 6, wherein at least one of the drivetrains comprises a spindle extension, extending in the longitudinal direction of the respective drive spindle, which spindle extension is non-rotationally connected with the respective drive spindle.

8. The drive system according to claim 7, wherein each drivetrain comprises a respective spindle extension, the spindle extensions being of equivalent torsional rigidity.

9. The drive system according to claim 8, wherein the spindle extensions are of equivalent length and cross section.

10. The drive system according to claim 8, wherein the spindle extensions have different lengths with a longer one of the spindle extension having a larger cross section than a shorter one of the spindle extensions.

11. A sheet metal processing machine comprising:

a machining tool configured to process sheet metal; and the drive system of claim 1 configured to move the machining tool.

12. The machine according to claim 11, further comprising a wedge gear positioned between the drive system and the machining tool, the wedge gear comprising two drive side wedge gear elements and two tool side wedge gear elements, wherein each drive side wedge gear element is associated with a respective tool side gear element, together forming a wedge gear element pair, wherein the wedge gear elements of each wedge gear element pair lie opposite each other on at least one wedge surface, and the wedge surfaces of both wedge gear element pairs are inclined in opposite directions relative to the spindle axes of the drive spindles of the drive system, wherein each of the drive side wedge gear elements is connected with one of the spindle nuts of the drive system and each of the tool side wedge gear elements is connected with the machining tool, and wherein the drive side wedge gear elements are configured to be moved jointly with the spindle nuts by the drive spindles, simultaneously with longitudinal movements in the longitudinal direction of the drive spindles, and that, thereby, a movement of the machining tool can be generated via the tool side wedge gear elements.

13. The machine according to claim 11, wherein the spindle nuts are configured to be moved by the two drive spindles simultaneously and with opposing longitudinal movements, wherein the drive side wedge gear elements are configured to be moved jointly with the spindle nuts by the drive spindles simultaneously and with opposing longitudinal movements in the longitudinal direction of the drive spindles, and wherein the drive side wedge gear elements, during simultaneous and opposing longitudinal movements relative to the tool side wedge gear elements, move in the longitudinal direction of the drive spindles, and, thereby, a transverse movement of the tool side wedge gear elements and of the machining tool can be generated in the transverse direction of the drive spindles.

14. The machine according to claim 13, wherein the machine further comprises a common guide for guiding the drive side wedge gear elements during simultaneous and converging longitudinal movements, in the longitudinal direction of the drive spindles, and wherein, in addition to the spindle nuts, the drive side wedge gear elements are also distanced from each other at the beginning of the simultaneous and converging longitudinal movements in the longitudinal direction of the drive spindles.

15. The machine according to claim 12, wherein the spindle nuts are configured to be moved by the two drive spindles simultaneously and with longitudinal movements in the same direction, wherein the drive side wedge gear elements are configured to be moved jointly with the spindle nuts by the drive spindles simultaneously and with equally directed longitudinal movements in the longitudinal direction of the drive spindles, wherein the drive side wedge gear elements, during their longitudinal movements, take the tool side wedge gear elements in the longitudinal direction of the drive spindles, a longitudinal movement of the machining tool thereby being generated by the tool side wedge gear elements in the longitudinal direction of the drive spindles.

16. The machine according to claim 14, wherein the drive side wedge gear elements are movable jointly with the spindle nuts by the drive spindles, simultaneously and with equally directed longitudinal movements in the longitudinal direction of the drive spindles, wherein the drive side wedge gear elements, during the longitudinal movements, take the tool side wedge gear elements in the longitudinal direction of the drive spindles, a longitudinal movement of the machining tool thereby being generated by the tool side wedge gear elements in the longitudinal direction of the drive spindles, and wherein the fixed bearing of the drive spindle set back relative to the other drive spindle, viewed in the direction of the simultaneous and equally directed longitudinal movements of the drive side wedge gear elements and the spindle nuts, is located such that, during the simultaneous and equally directed longitudinal movements of the drive side wedge gear elements and the spindle nuts the fixed bearing may be passed by at least one of the drive side wedge gear elements and spindle nuts.

17. The machine according to claim 16, wherein the fixed bearing is located such that during the simultaneous and equally directed longitudinal movements of the drive side wedge gear elements and the spindle nuts the fixed bearing may be passed by the drive side wedge gear element or spindle nut moving ahead in the direction of the simultaneous and equally directed longitudinal movements of the drive side wedge gear elements and spindle nuts.

18. The machine according to claim 16, comprising two drive motors, each drive motor engaging a respective one of the two drive spindles, and two drivetrains, each drivetrain connecting a respective one of the drive spindles to an associated drive motor, the drivetrains being of equivalent torsional rigidity, wherein one of the drive spindles has a spindle extension and a fixed bearing that may be passed by at least one of the drive side wedge gear elements or spindle nuts moving ahead in the direction of the simultaneous and equally directed longitudinal movements of the drive side wedge gear elements and spindle nuts.

19. A machine tool drive system comprising:

a spindle arrangement that has at least one drive spindle; two spindle nuts, the spindle arrangement comprising two drive spindles extending parallel to each other along a longitudinal direction, each drive spindle supported for rotation about a respective spindle axis and configured to be driven about the respective spindle axis, the two drive spindles being of identical torsional and axial rigidity and each having a fixed bearing at one end, acting in the longitudinal direction of the respective drive spindle;

wherein the two spindle nuts are configured to be moved by the spindle arrangement simultaneously with longitudinal movements in the longitudinal direction of the drive spindles, each of the spindle nuts seated on an associated one of the two drive spindles; and two drive motors, each drive motor engaging a respective one of the two drive spindles, and two drivetrains, each drivetrain connecting a respective one of the drive spindle to a respective one of the drive motors, wherein the drivetrains are of equivalent torsional rigidity, wherein the spindle nuts are moveable by the spindle arrangement, in the longitudinal direction of the drive spindles, by each of the spindle nuts being movable by the associated drive spindle, and wherein at least one of the drivetrains comprises a spindle extension, extending in the longitudinal direction of the respective drive spindle, which spindle extension is non-rotationally connected with the respective drive spindle.

20. A sheet metal processing machine comprising:

(a) a machining tool configured to process sheet metal;

(b) a machine tool drive system comprising:

a spindle arrangement that has at least one drive spindle, and two spindle nuts, the spindle arrangement comprising two drive spindles extending parallel to each other along a longitudinal direction, each drive spindle supported for rotation about a respective spindle axis and configured to be driven about the respective spindle axis, the two drive spindles being of identical torsional and axial rigidity and each having a fixed bearing at one end, acting in the longitudinal direction of the respective drive spindle; and wherein the two spindle nuts are configured to be moved by the spindle arrangement simultaneously with longitudinal movements in the longitudinal direction of the drive spindles, each of the spindle nuts seated on an associated one of the two drive spindles;

wherein the spindle nuts are moveable by the spindle arrangement, in the longitudinal direction of the drive spindles, by each of the spindle nuts being movable by the associated drive spindle; and (c) a wedge gear positioned between the drive system and the machining tool, the wedge gear comprising two drive side wedge gear elements and two tool side wedge gear elements, wherein each drive side wedge gear element is associated with a respective tool side gear element, together forming a wedge gear element pair, wherein the wedge gear elements of each wedge gear element pair lie opposite each other on at least one wedge surface, and the wedge surfaces of both wedge gear element pairs are inclined in opposite directions relative to the spindle axes of the drive spindles of the drive system, wherein each of the drive side wedge gear elements is connected with one of the spindle nuts of the drive system and each of the tool side wedge gear elements is connected with the machining tool, wherein the drive side wedge gear elements are configured to be moved jointly with the spindle nuts by the drive spindles, simultaneously with longitudinal movements in the longitudinal direction of the drive spindles, and, thereby, a movement of the machining tool being able to be generated via the tool side wedge gear elements wherein at the start of their simultaneous longitudinal movements, the spindle nuts are not distanced from each other in the longitudinal direction of the drive spindles, and wherein during opposing longitudinal movements a first spindle nut of the spindle nuts, together with a projection, supporting it in rotation, of the drive side gear wedge connected with the first spindle nut, enters a recess at the drive side gear wedge connected with a second spindle nut of the spindle nuts and the second spindle nut, together with a projection, supporting it in rotation, of the drive side gear wedge connected with the second spindle nut, enters a recess at the drive side gear wedge connected with the first spindle nut.

* * * * *